US005731828A

United States Patent [19]

Ishinaga et al.

[11] Patent Number: 5,731,828

[45] Date of Patent: Mar. 24, 1998

[54] INK JET HEAD, INK JET HEAD CARTRIDGE AND INK JET APPARATUS

[75] Inventors: Hiroyuki Ishinaga, Tokyo; Kazuaki Masuda, Kawasaki; Junji Shimoda, Chigasaki; Masami Kasamoto, Ayase; Fumio Murooka, Atsugi; Tatsuo Furukawa, Isehara; Jun Kawai, Tokyo; Hiroyuki Maru, Atsugi; Teruo Arashima; Masaaki Izumida, both of Kawasaki; Yoshinori Misumi, Tokyo; Yuji Kamiyama, Fujisawa, all of Japan

[73] Assignee: Canon Kabushiki Kaisha, Tokyo, Japan

[21] Appl. No.: 546,084

[22] Filed: Oct. 20, 1995

[30] Foreign Application Priority Data

Oct. 20, 1994 [JP] Japan ..... 6-255631

[51] Int. Cl.[6] ..... B41J 2/05

[52] U.S. Cl. ..... 347/62; 347/48; 347/56

[58] Field of Search ..... 347/48, 56, 62, 347/63, 67; 358/296

[56] References Cited

U.S. PATENT DOCUMENTS

| | | | |
|---|---|---|---|
| 4,251,824 | 2/1981 | Hara et al. | 346/140 R |
| 4,646,110 | 2/1987 | Ikeda et al. | 346/140 R |
| 4,860,033 | 8/1989 | Shiozaki et al. | 346/140 R |
| 4,875,059 | 10/1989 | Masuda | 346/140 R |
| 4,980,702 | 12/1990 | Kneezel et al. | 347/17 |
| 4,994,825 | 2/1991 | Saito et al. | 346/140 R |
| 5,081,474 | 1/1992 | Shibata et al. | 346/140 R |
| 5,095,321 | 3/1992 | Saito et al. | 346/140 R |
| 5,148,192 | 9/1992 | Izumida et al. | 346/140 R |
| 5,172,139 | 12/1992 | Sekiya et al. | 347/48 |
| 5,208,604 | 5/1993 | Watanabe et al. | 346/1.1 |
| 5,214,450 | 5/1993 | Shimoda | 346/140 R |
| 5,359,352 | 10/1994 | Saita et al. | 347/62 |
| 5,361,087 | 11/1994 | Tajima et al. | 347/44 |
| 5,481,287 | 1/1996 | Tachihara | 347/62 |
| 5,646,660 | 7/1997 | Murray | 347/59 |

FOREIGN PATENT DOCUMENTS

| | | |
|---|---|---|
| 0124312 | 11/1984 | European Pat. Off. . |
| 0613781 | 9/1994 | European Pat. Off. . |
| 55-132359 | 10/1980 | Japan . |
| 62-35852 | 2/1987 | Japan . |
| 1-235652 | 9/1989 | Japan . |
| 2-239940 | 9/1990 | Japan . |

*Primary Examiner*—Stuart N. Hecker

*Attorney, Agent, or Firm*—Fitzpatrick, Cella, Harper & Scinto

[57] ABSTRACT

An ink jet head includes a plurality of liquid flow paths for ejecting the ink; and a plurality of heat generating resistors for the respective liquid flow paths, the heat generating resistor being independently drivable; wherein adjacent ones of the heat generating resistors are spaced by not more than 8 microns.

16 Claims, 19 Drawing Sheets

| S-HTR | L-HTR |
|---|---|
| OFF | OFF |
| EJECTION=0ng | |

| S-HTR | L-HTR |
|---|---|
| ON | OFF |
| EJECTION=30ng | |

| S-HTR | L-HTR |
|---|---|
| OFF | ON |
| EJECTION=60ng | |

| S-HTR | L-HTR |
|---|---|
| ON | ON |
| EJECTION=90ng | |

| | S-HTR 10ng | M-HTR 20ng | L-HTR 40ng | EJECTION [ng] |
|---|---|---|---|---|
| 1 | OFF | OFF | OFF | 0ng |
| 2 | ON | OFF | OFF | 10ng |
| 3 | OFF | ON | OFF | 20ng |
| 4 | ON | ON | OFF | 30ng |
| 5 | OFF | OFF | ON | 40ng |
| 6 | ON | OFF | ON | 50ng |
| 7 | OFF | ON | ON | 60ng |
| 8 | ON | ON | ON | 70ng |

INK JET HEAD, INK JET HEAD CARTRIDGE AND INK JET APPARATUS

FIELD OF THE INVENTION AND RELATED ART

The present invention relates to an ink jet head, an ink jet head cartridge and an ink jet device usable as a printer, a video printer or the like as an output terminal for a copying machine, a facsimile machine, a word processor, a host computer, a video printer or the like. In this specification, recording includes applicatin of ink onto any ink supporting material for receiving the ink, such as textile, thread, paper, sheet material (print), and what is recorded includes meaningful image such as letter or the like and meaningless image such as pattern images. The recording device includes various information processing device or a printer as an output device therefor, and the present invention is applicable to all of them.

An ink jet recording device which ejects ink onto a recording material to effect the recording has been put into practice, and may of them are produced, since it is advantageous in the easiness of downsizing, low noise or the like.

Recently, further downsizing or further improvement of the image quality particularly in color image recording, is demanded. In order to meet the demand, Japanese Laid Open Patent Application No. SHO-55-132259 has proposed a construction wherein a plurality of electrical heat exchange elements are provided in one nozzle. These electrothermal transducer elements are independently controlled and driven, so that size of the ink droplet ejected is controlled to accomplish high image quality recording (tone gradient recording method).

The investigations of the inventors in this respect have revealed the following.

An area of electrothermal transducer element is normally one of an important factors of determination of ejection amount of the ink. However, the maximum ejection amount of the ink when the plurality of the electrothermal transducer elements are used, is not determined be the total of the areas of the plurality of electrothermal transducer elements.

Since the heat produced by an electrothermal transducer element is influential to another electrothermal transducer. Therefore, the desired ink ejection amount is not accomplished easily.

The circuit construction on an element substrate (heater board) for driving the electrothermal transducer element in an example, is as shown in FIG. 22 or FIG. 23.

In FIG. 22, the electric signal is directly supplied to the electrothermal transducer element 012 through wiring and outside end portion 015 (direct wiring construction).

With such a circuit construction, the construction in the element substrate is simple, but as to the number of of the contacts, when the number of of the electrothermal transducer elements is n, at least n+ one contacts are necessary. When a plurality of electrothermal transducer elements are provided in a single nozzle with such a circuit construction used, a very many electrical connections are necessary between the element substrate and the outside devices, with the result of complication of the manufacturing step and bulkiness of the element substrate.

The element substrate of FIG. 23 has electrothermal transducer element 012, wiring 013, diode 014 and contact for external connection. When electric energy supply is effected by the matrix construction constituted by wiring and diode. By the use of the diode matrix construction, the number of of the contacts 015 for the external connection is reduced to 2n when the number of of the electrothermal transducer elements is n.

Even if, however, such a wiring construction is used, the number of of the connection contacts is quite large in the case of tone gradient recording head.

As described above, the head having a plurality of of heat generating resistors in 1 nozzle, involves the problem of lowering of the ejection efficiency or deviation from a desired ejection amount.

SUMMARY OF THE INVENTION

Accordingly, it is a principal object of the present invention to provide an ink jet head, a head cartridge, and an ink jet recording device capable of affecting high image quality recording with high tone gradient and improved ejection efficiency.

It is another object of the present invention to provide an ink jet head, ink jet head cartridge and ink jet device wherein increase of the number of of electrical contacts on an element substrate resulting from a plurality of electrothermal transducer elements in a single nozzle and the resultant bulkiness of the substrate, can be prevented.

It is a further object of the present invention to provide a container for ink containing ink properly refilled thereinto, usable in an ink jet head or an ink jet head cartridge according to the present invention.

According to the present invention, the position of a plurality of heat generating resistors are optimization in a single nozzle (flow path).

According to the present invention, the function elements for driving the heat generating resistors in such a head are built in the same element substrate, by which the number of of the electrical contacts for the external connections can be decreased, and the downsizing of the element substrate is accomplished. As an ink container for constituting such an ink jet head or ink jet cartridge, an ink container to which the ink is refilled is used, so that the repeated use is permitted, so that the ink jet cartridge can be used for a long term.

According to an aspect of the present invention, there is provided An ink jet head comprising a plurality of liquid flow paths for ejecting the ink; and a plurality of heat generating resistors for said respective liquid flow paths, said heat generating resistor being independently drivable; wherein adjacent ones of said heat generating resistors are spaced by not more than 8 microns.

According to another aspect of the present invention, there is provided an ink jet head cartridge having a maintaining for containing the ink to above-described ink jet head or the ink jet head.

According to a further aspect of the present invention, there is provided an ink jet device having the ink jet head and transporting means for transporting a recording material.

According to a further aspect of the present invention, there is provided an ink jet device having a driving signal supply means for driving such an ink jet head or said ink jet head.

According to a further aspect of the present invention, there is provided a refilled ink container for above-described ink jet head cartridge.

While the invention has been described with reference to the structures disclosed herein, it is not confined to the details set forth and this application is intended to cover such modifications or changes as may come within the purposes of the improvements or the scope of the following claims.

DESCRIPTION OF THE PREFERRED EMBODIMENTS

Referring to the accompanying drawings, the embodiments of the present invention will be described. In this embodiment, ink is used as the liquid to be ejected, but the present invention is not limited to the ink and is usable with the liquid which can be ejected using the device of the present invention.

Before describing the embodiment, the description will be made as to the finding obtained by the inventors.

Figure 1A:
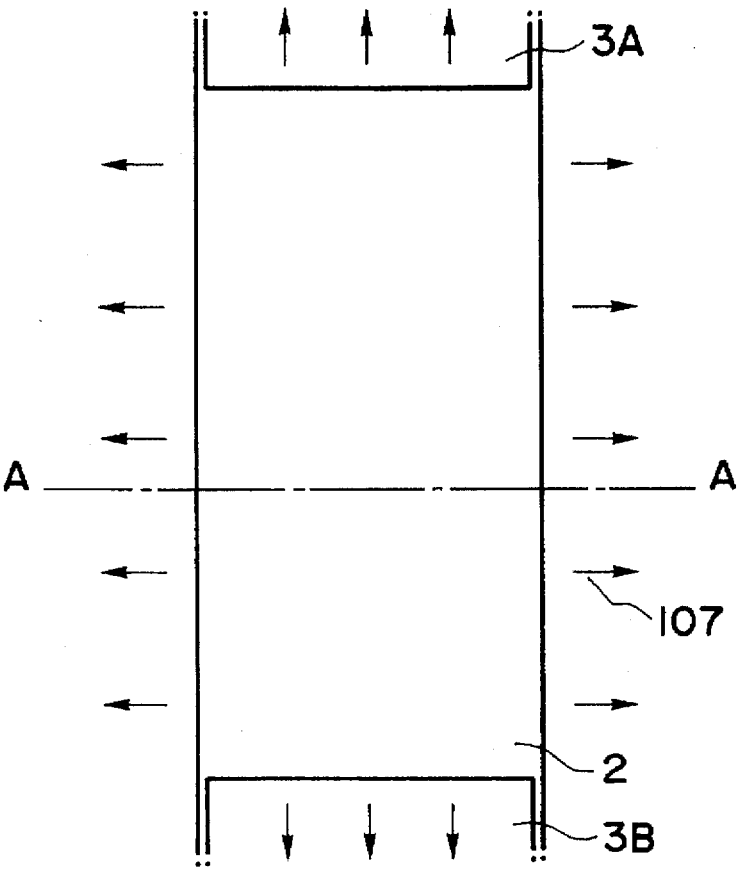
FIGS. 1(*a*) and 1(*b*) illustrate a bubble generation region of an electrothermal transducer element.
Figure 1B:
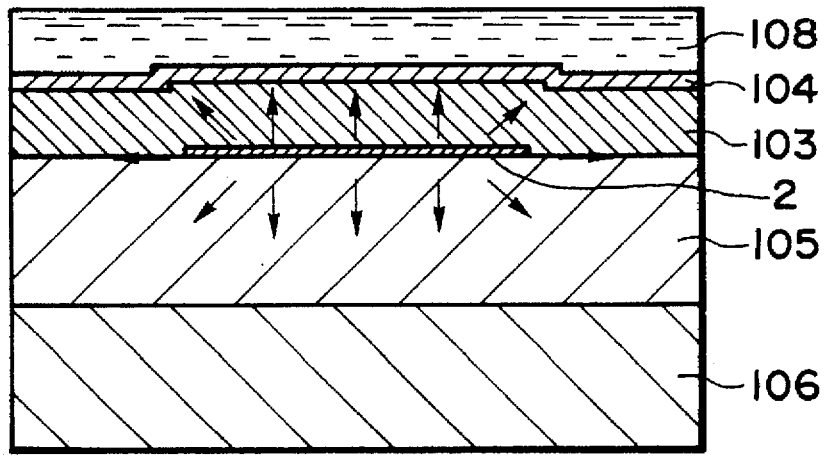

FIG. 1 is a top plan view (a) of an electrothermal transducer element on an element substrate, and a A—A sectional view (b) thereof.

The electrothermal transducer element on the element substrate comprises a heat generating resistor (ejection heater) 2 for producing the heat and electrodes 3A and 3B connected to the ejection heater 2 through a thin film forming process. By application of an electric signal between the two electrodes, current flows through the ejection heater 2 to generate the heat. The heat produced by the ejection heater 2 heat radiates in a direction of arrow 107 in (a) namely along the surface, and in a direction thereacross as shown in same figure (b). The ejection heater 2 has a sandwich structure comprising a heat accumulation layer 105 of low thermal conductivity, a protection layer 103 for protection of the heater and an anti-cavitation layer 104 against shock wave upon collapse of bubble in ink. The base 106 is of silicon crystal or the like. The thickness of the respective layers is determined so as to transfer the heat from the ejection heater 2 to the ink 108. In the case of of the present invention, anti-cavitation layer 104 is 0.1–1.0 micron, protection layer 103 is 0.3–2.0 microns, and heat accumulation layer 105 is 0.5–5.0 microns approx. and the base 106 is 0.5–1.0 mm, in thickness, usually.

When the of the contact surface between the anti-cavitation layer 104 and the ink 108 is approx. 300° C., the bubble generation starts, and is set as a temperature at which the bubble generation occurs stably at the temperature of not less than 300° C. The ejection heater 2 exhibit low durability abruptly when the surface exceeds the temperature of approx. 700°–800° C. due to the stress resulting from inserting in thermal-expansion coefficients between the protection layer 103 or between the heat accumulation layer 105 or due to the durable temperature. It is desirable that the surface temperature is controlled so as nor to exceed the temperature.

Figure 2:
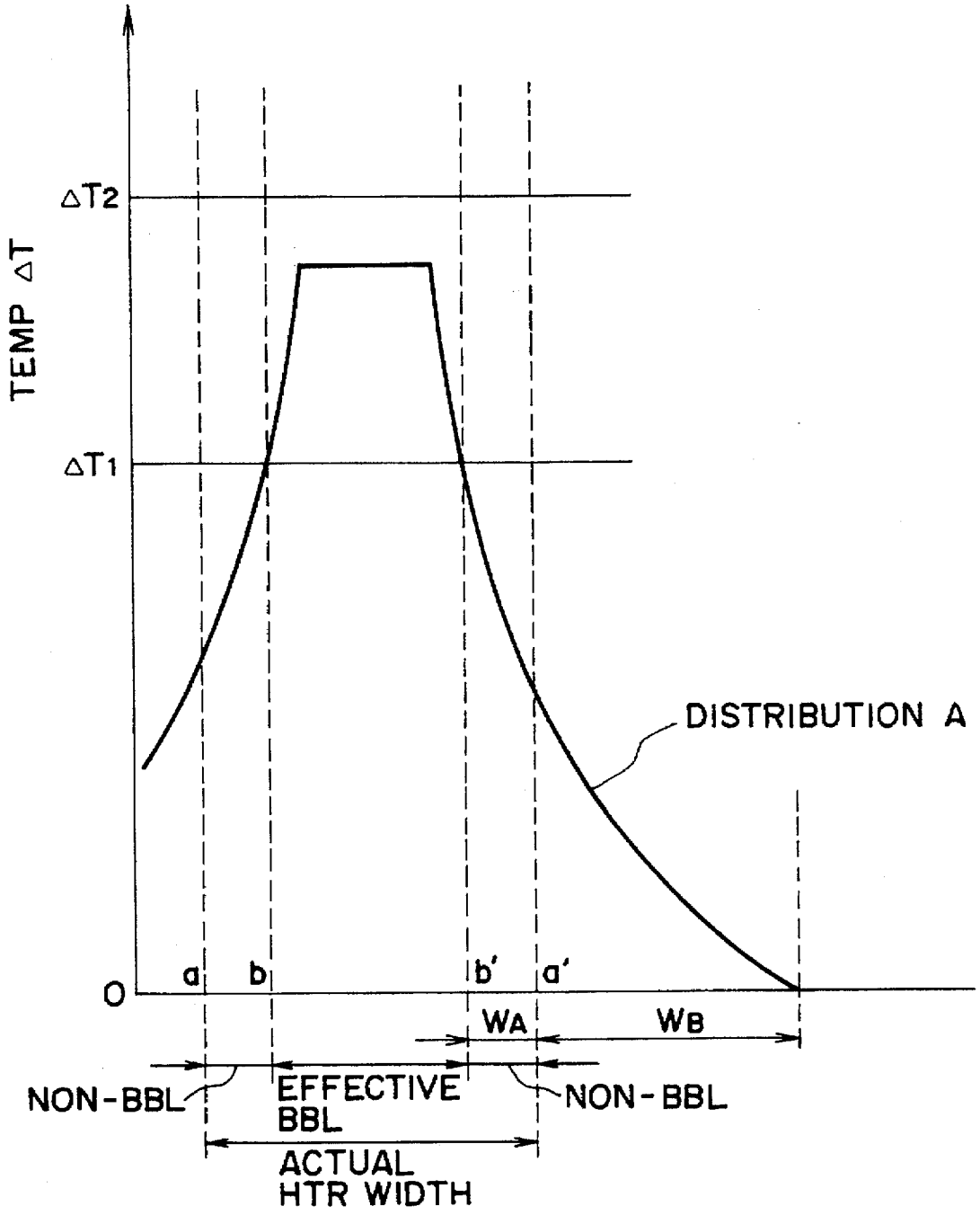
FIG. 2 illustrates a bubble generation region of an electrothermal transducer element.

Referring to FIG. 2, this will be described further using the surface temperature distribution shown therein. The ordinate represents a temperature, and the abscissa represents a distance of the ejection heater in the direction of the flow path cross-section. Here, a–a' corresponds to the width of the heater in FIG. 1, (a), and the temperature distribution at the surface of the anti-cavitation layer 104 is indicated by Temp A. The $\delta T_1$ is a bubble generation start temperature and is approx. 300° C., and $\delta T_2$ is a temperature at which the durability changes abruptly. It is different if the thin film material is different but is usually approx. 700°–800° C. With Temp a, the range of $\delta T_1$–$\delta T_2$ temperature region is the region where the bubble generation occurs in the ink, as indicated by b–b' Here, it will be noted that the temperature distribution at the central portion is flat, and the bubble generation/collapse are stably repeated, and therefore, the more stable printing property can be provided if this region is larger. Adjacent the end portion of the heater, the heat radiation occurs in the direction of the surface, as shown in FIG. 1 with the result that the temperature gradually decreases, and $W_A$ is a non-bubble-generation region incapable of bubble generation of the ink although it is on the ejection heater. A further outside portion of the ejection heater exhibit some degree of temperature rise due to the heat radiation in the direction of the surface. Thus, the temperature distribution has an exponentially expanding nature (curve), and therefore, around the ejection heater, a width (approx. 8 microns) of non-bubble-generation exists (non-bubble-generation region). In order to improve the ejection efficiency of the ink by reducing this region, it would be considered to rise the overall temperature.

However, if this is done, the temperature of the maximum temperature region at the center portion of the ejection heater would exceed the durability deterioration temperature, that is $\delta T_2$ with the result of reduced lifetime of the ejection heater. For this reason, it is difficult to increase the overall temperature.

EMBODIMENT 1

Figure 3:
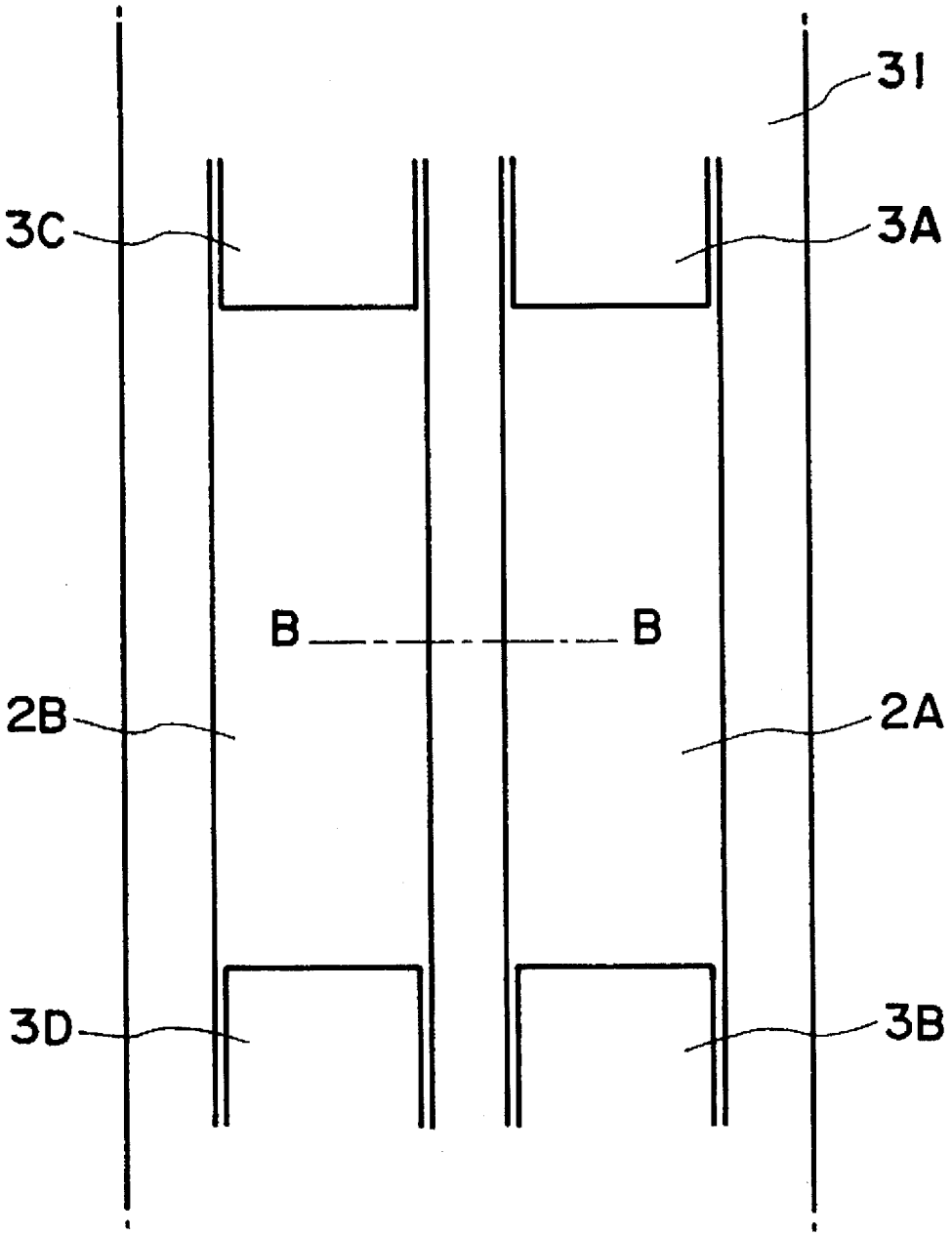
FIG. 3 illustrates a structure wherein a plurality of of electrothermal transducer are provided in 1 flow path.

In the present invention, as shown in FIG. 3, one liquid flow path (nozzle) 31 has a plurality of of ejection heaters (heat generating resistors) which are independently drivable. In this embodiment, as shown in FIG. 3, there are provided ejection heaters of rectangular forms which are substantially the same having long sides along the liquid flow path. The two ejection heaters are disposed substantially in parallel with each other. They are remote from the ejection outlet substantially at the same distances. By doing so, a temperature distribution as shown in FIG. 4 can be provided by optimizing the positions of the plurality of heat generating resistors, so that the non-bubble-generation region can be reduced while maintaining the temperature of the heater in the stabilization region at $\delta T_1$–$\delta T_2$.

Figure 4:
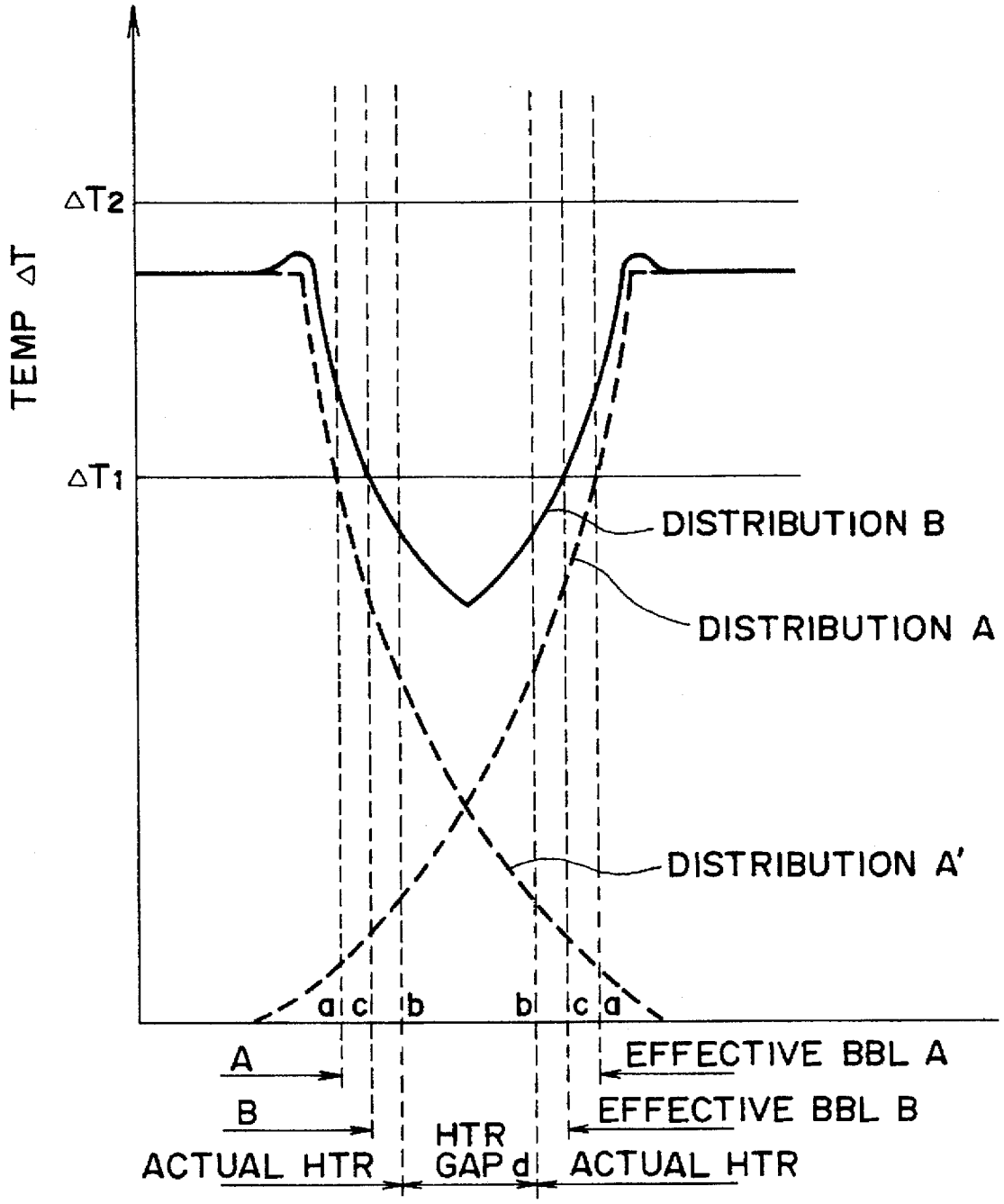
FIG. 4 illustrates a bubble generation region of the electrothermal transducer element in FIG. 3.

FIG. 4 shows a temperature distribution on B—B line between the two heaters in FIG. 3. When the ejection heaters 2A and 2B are independently driven, the temperatures are as indicated by Temp a, Temp a', and therefore, the respective temperatures are the same as conventional ones. When they are simultaneously driven, the portions of the temperature distribution exponentially expanding at the heater edges are overlapped so that the total temperature distribution is as indicated by Temp B, and effective bubble generation region of the heater is larger as indicated by B than the conventional one as indicated by A. Thus, the non-bubble-generation region is reduced, and the bubble generation efficiency can be enhanced. The non-bubble-generation region is normally a–b which is approx. 8 microns wide, but by using 12 microns as the clearance between 2 heaters (the distance between adjacent edges), it can be reduced to approx. 5 microns. The smaller the distance between heaters, the more effective. If the point at which $\delta T=0$ in the distribution Temp a of one of the heaters is over the other ejection heater, the effect of enlargement of the area of effective bubble generation is provided. Particularly, the effect is high if the distance between the heaters is such that the $\delta T=0$ point of the Temp a reaches the effective bubble generation region of the other heater. The condition satisfying this is $d \leqq 8$ microns. The non-bubble-generation region is decreased by decreasing the clearance between heaters (heat generating resistors) to not more than 8 microns so that effective bubble generation area can be enlarged. If $d \leqq 6$ microns is satisfied, the temperature rise due to the heat radiation from the 8 microns width of the non-bubble-generation regions become not less than twice, and the minimum temperature point in the temperature distribution Temp b exceeds the level $\delta T_1$ with the result that the non-bubble-generation region is reduced. Further preferably, if $d \leqq 4$ microns is satisfied, the bubble generation region can be assured stably with flatter temperature distribution. As will be understood from Temp a of FIG. 2, if the heater width is not more than 16 microns ($2\ W_A$, the bubble generation region does not have a flat surface, and therefore, the effective region hardly exists between the unstable region and the durability deterioration region. However, in the case of the multi-heater as in the present invention, the stabilized effective bubble generation region can be provided even if the heater has a width not more than 16 microns.

The clearance between the heat generating resistors is a clearance between adjacent edges of the heat generating resistors.

By the reduction of the non-bubble-generation region, the following effects are provided.

1. corresponding to the reduction of the heater size required for the predetermined ejection amount, energy saving is accomplished, so that the voltage source cost and the driver cost can be saved.
2. since the heat generation In the non-bubble-generation region results in the wasteful energy and in addition functions to rise the temperature of the head, the viscosity of the ink having the temperature dependence property decreases with the result of variation of the ejection amount and therefore deterioration of the printing quality. However, the above-described reduction of the non-bubble-generation region can suppress the reduction of the viscosity and the deterioration of the printing quality.

These effects are particularly remarkable in a narrow heater having a smaller width.

EMBODIMENT 2

In the foregoing, the non-bubble-generation region of the heat generating resistor is decreased by optimizing the positions of the heat generating resistors (ejection heaters) in one nozzle. In this embodiment, a plurality of heat generating resistor are provided in a single nozzle, similarly, and the circuit of the element substrate is so constructed as to efficiently driving the heat generating resistors and to downsize the element substrate.

In this embodiment, "on the substrate" is not strictly limited to the surface of the substrate but covers the inside portion adjacent the surface.

Figure 5:
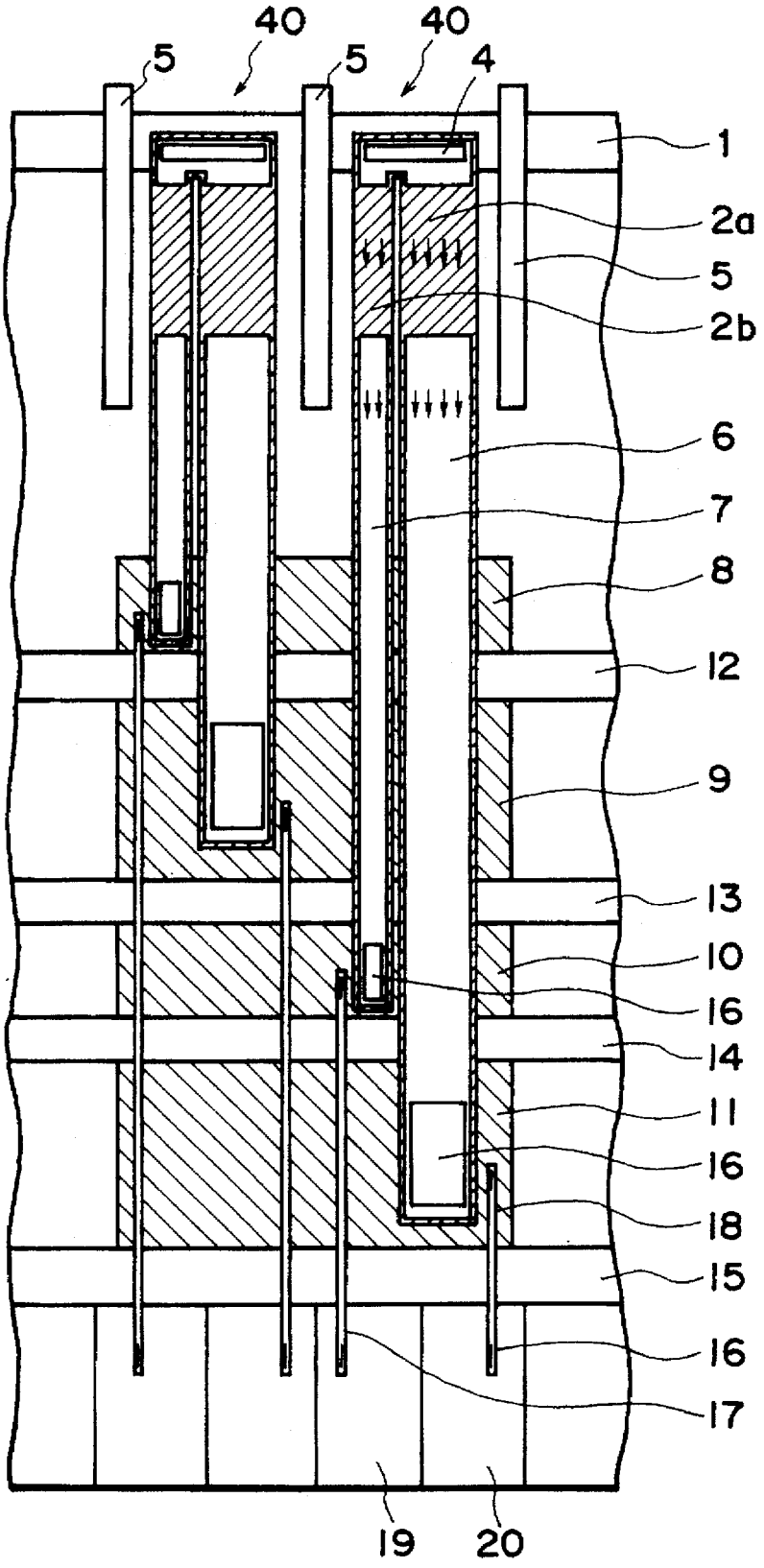
FIG. 5 illustrates an element position on a substrate constituting a base of an ink jet recording head according to an embodiment of the invention.

FIG. 5 shows an arrangement of elements integrally built in the element substrate through a semiconductor manufacturing step, in an ink jet head according to an embodiment of the present invention. On the element substrate, nozzle walls 5 are provided, and in a single ejection nozzle between adjacent nozzle wall 5, there are provided a large heat generating resistor (ejection heater) **2*a* and a small ejection heater 2*b* under the same conditions as in the foregoing embodiment. The respective ejection heaters are connected with a common wiring 1 below a lower insulation heater of the ejection heater through through hole 4 so as to be supplied with a voltage. Wiring 6 and 7 are connected between large ejection heater 2*a* and small ejection heater 2*b* and switching transistor s11 and 10, respectively through the through hole 16**.

Figure 6:
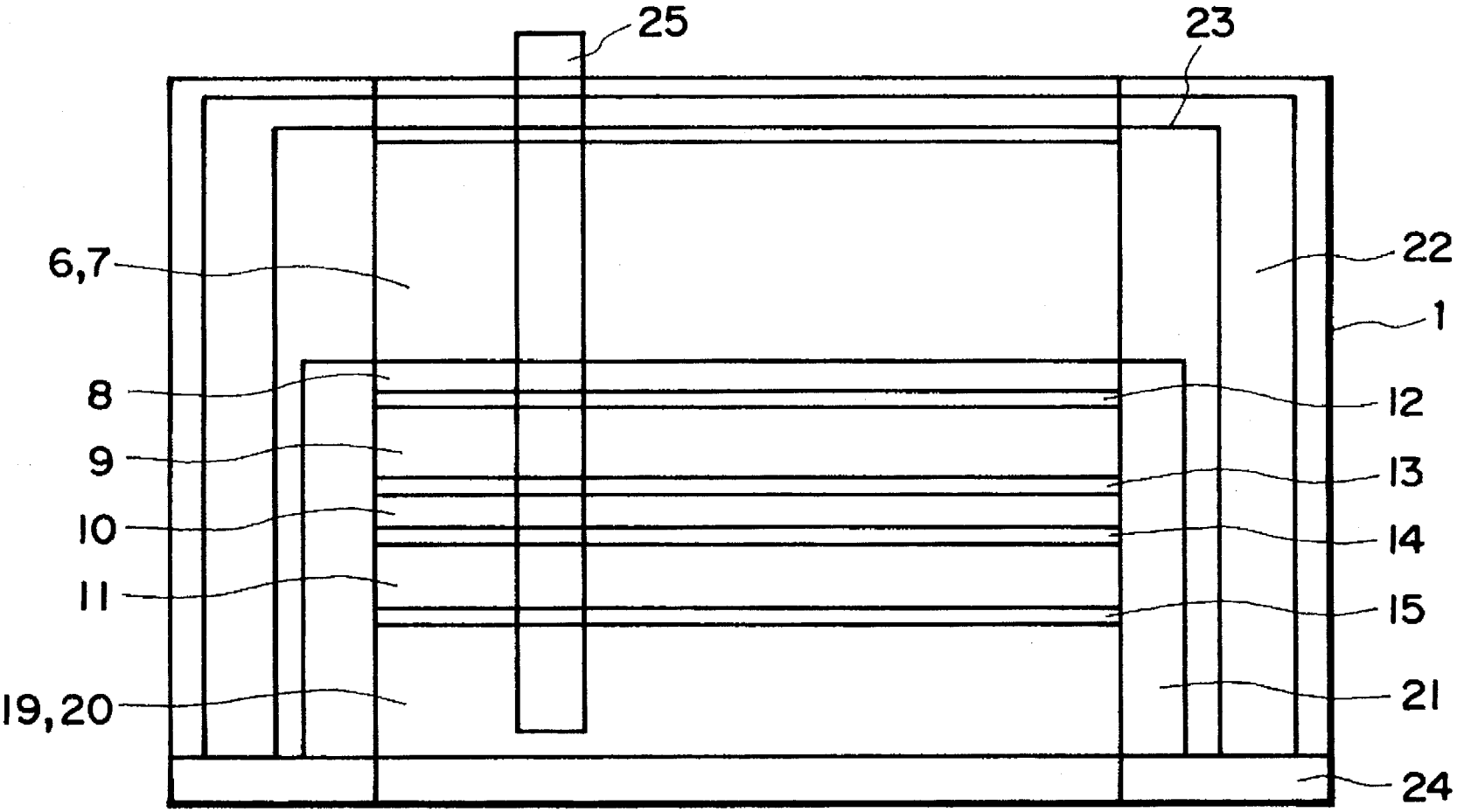
FIG. 6 shows a general arrangement of a substrate constituting a base of the ink jet recording head of FIG. 5.
Figure 7:
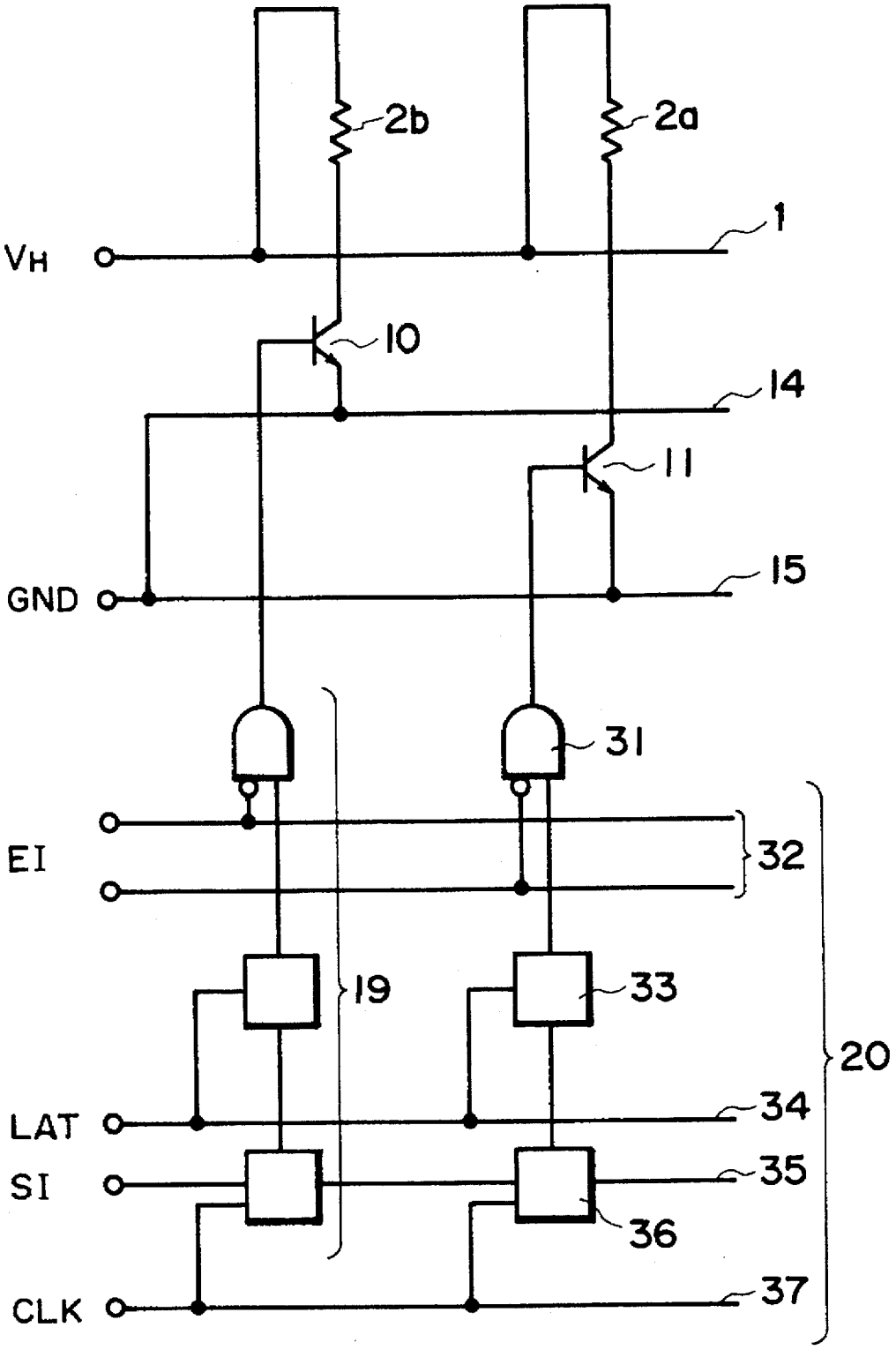
FIG. 7 shows an equivalent circuit of FIG. 5.
Figure 8:
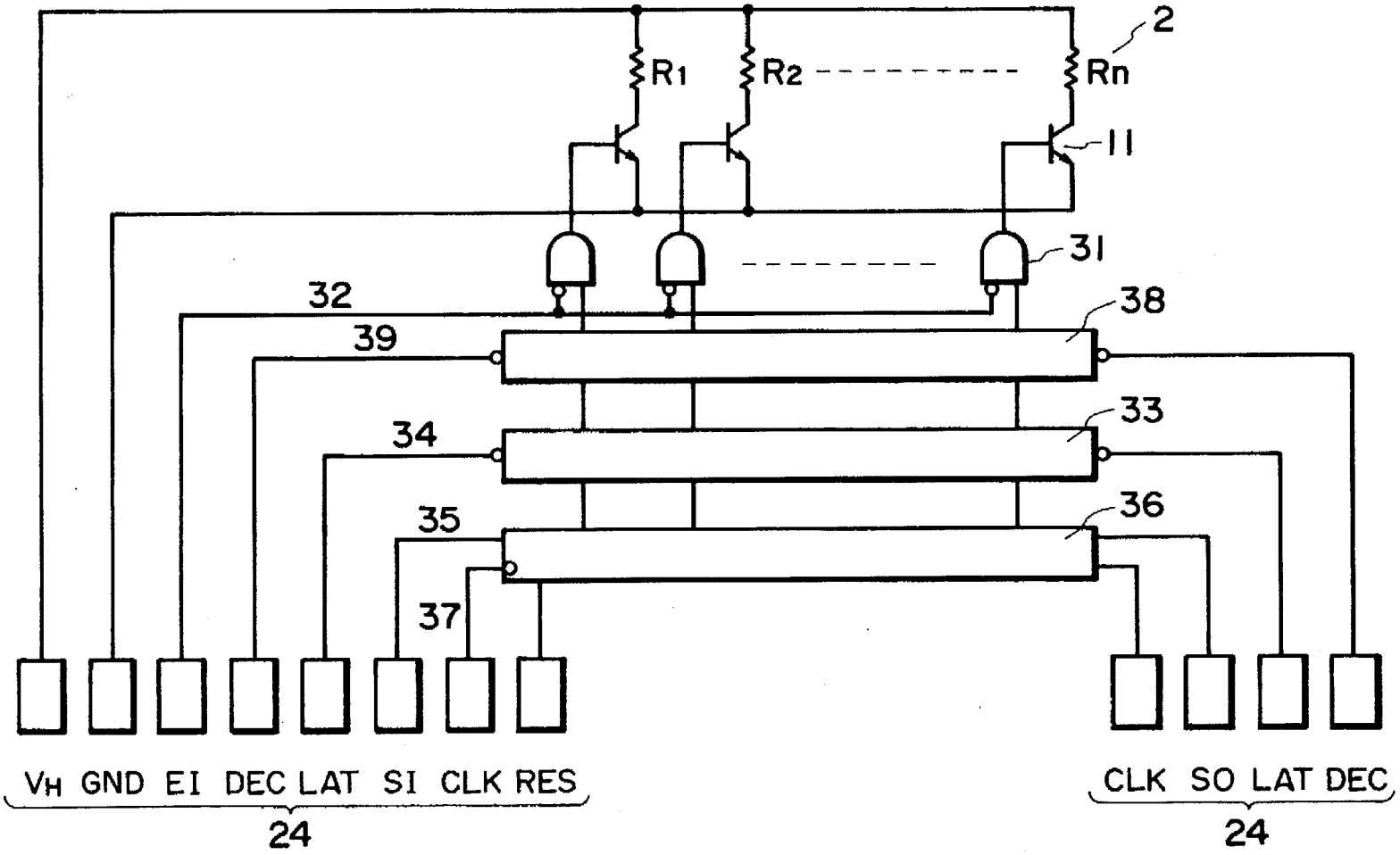
FIG. 8 shows an equivalent circuit of FIG. 6.
Figure 9:
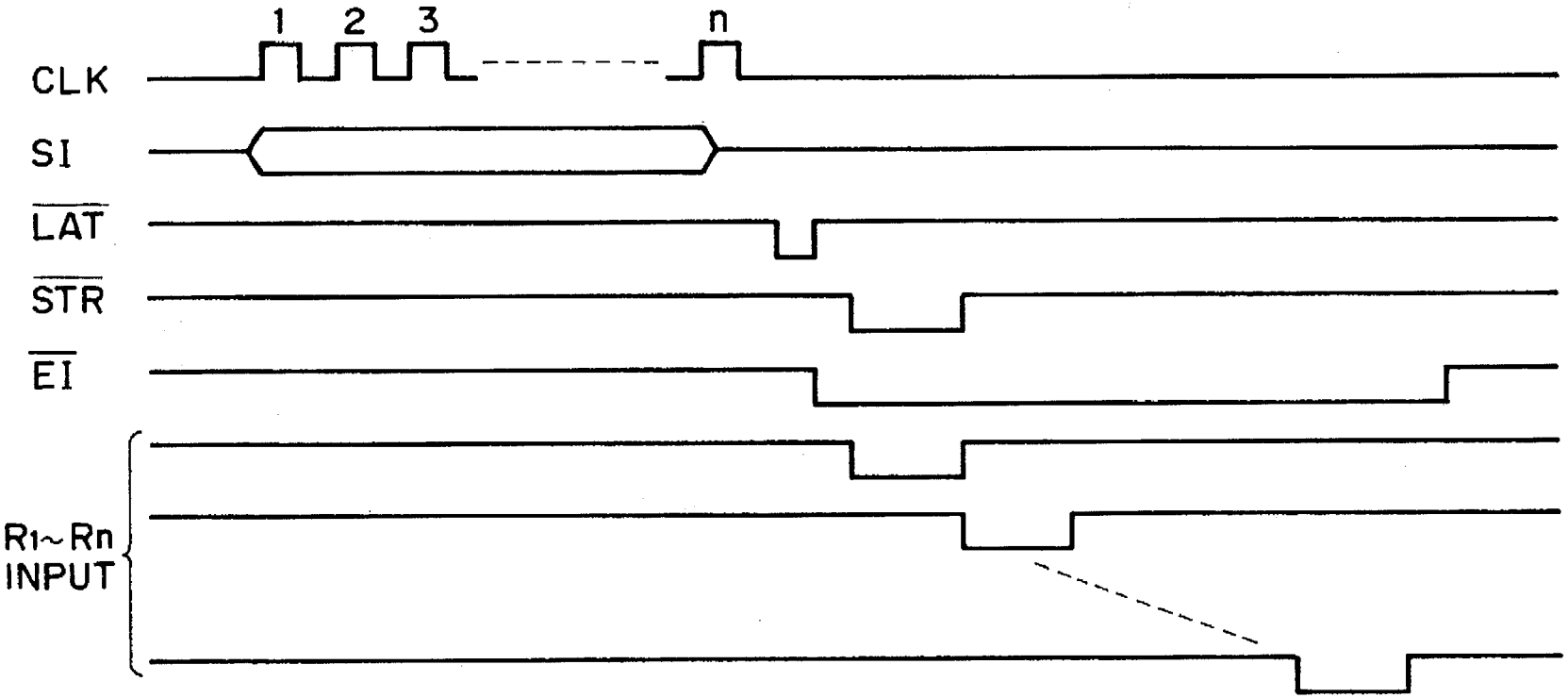
FIG. 9 is timing chart of driving of an ink set recording head according to and embodiment of the present invention.
Figure 10A:
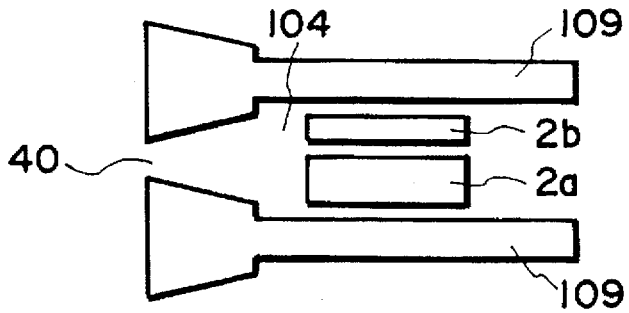
FIGS. 10(*a*)–10(*d*) show an example of control for ejection state of the ink in an ink jet recording head according to an embodiment of the present invention.
Figure 10B:
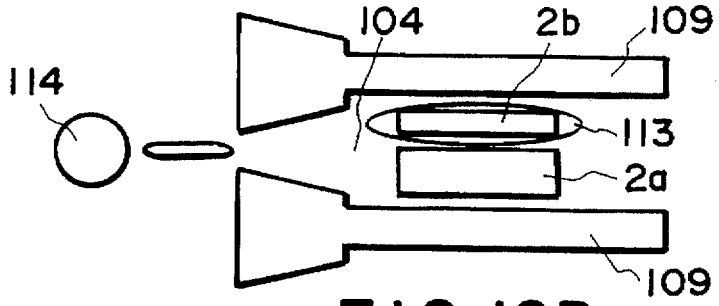
Figure 10C:
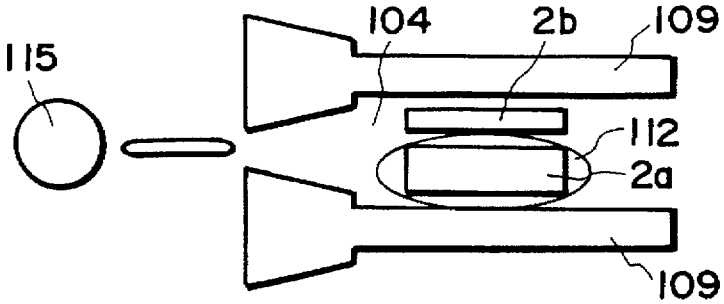
Figure 10D:
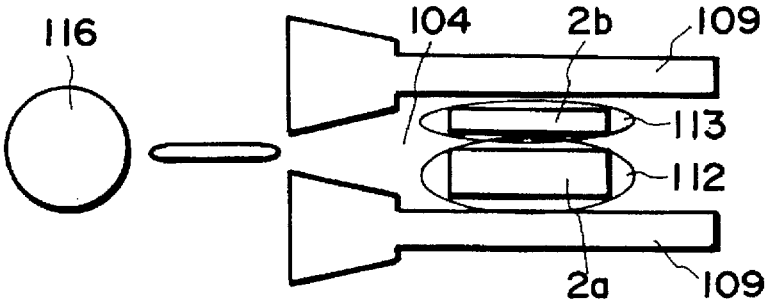

The switching transistors 10 and 11 are also disposed below the lower insulation film of the heater. In order to limit ON/OFF of the transistors 10 and 11, signal wiring 17 and 18 is connected between the transistors 10 and 11 and the shift registers and latching circuits 19 and 20. By doing so, the driving of the heater is limited by ON/OFF of the transistors in accordance with the data taken by the shift register and the latching circuit. Ground wirings 12, 13, 14 and 15 are connected to emitters of the switching transistors 8, 9, 10 and 11. In FIG. 5, two nozzles are shown. FIG. 6 shows the entire arrangement of the element substrate. In FIG. 6, the element substrate 1 is constructed by the continuous arrangement of the cells 25 of single structure. The common wiring 23 is connected to contact of 24 by a common longitudinal wiring 22 to permit electric energy supply thereto. Ground wirings 12, 13, 14 and 15 are connected to contact of 24 by ground longitudinal wiring 21. FIG. 7 shows details of the shift register, the latching circuits 19 and 20. The the shift register 36, CLK signal line 37 and serial data line 35 are supplied to convert the serial data to the shift register 36 in accordance with the clock signal. The data supplied to the shift register 36 are retained in the latch 33 by the latching signal from the latching signal line Then, the enabling signal 32 is connected to a AND gate 31 to supply a timing signal for applying the data from the latch 33 to the transistor 11. Since there are two enabling signals 32, the ejection heaters 2a and 2b can be driven simultaneously or at different timing. FIG. 8 shows an equivalent circuit of the general arrangement of the substrate 23 wherein the cells of FIG. 7 are continuously arranged. There are a decoder circuit 38 and a decoder signal line 39, which function to change the driving timing, thus permitting drive at various timings with a smaller number of contacts, that is, without a plurality of enabling signals 32. FIG. 9 shows a fundamental timing chart.

Figure 11:
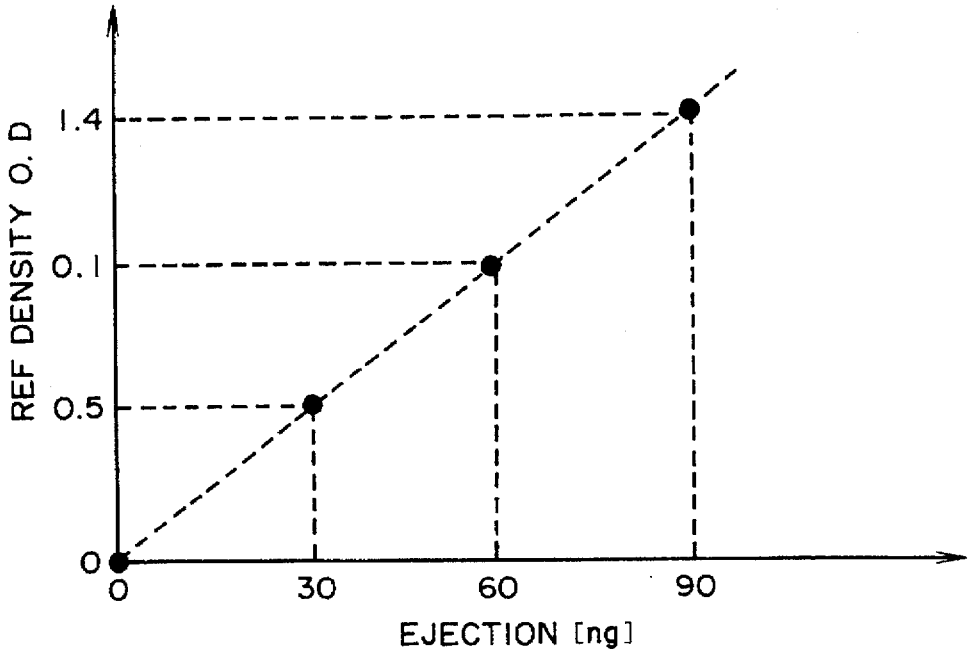
FIG. 11 shows a reflection temperature when an image is formed using a control of FIG. 10.

FIG. 10 shows a control of ejection amount of ink using the element substrate. As shown in (a), the ejection nozzle 104 between the nozzle walls 109 is filled with ink. When the ejection heaters 2a and 2b are heated to generate a bubble, the ink is ejected by the bubble generation pressure through the orifice 40. As shown in (b), the small ejection heater 2b is energized, and the small droplet 114 of the ink is ejected. The ejection amount at this time is approx. 30 ng, for example. Then, (c) shows the ejection of a large droplet 115 by a large scale bubble generation 112 by energization of the large ejection heater 2a. If the large ejection heater 2a has an area which is twice the area of the small ejection heater 2b, the ejection amount which is proportional to the area of the heater, the ejection amount is approx. 60 ng. In (d), both of the small ejection heater 2b and the large ejection heater 2a are energized. In this case, the area of the ejection heater is 3 times as large as the small ejection heater (in the case of (b)), and the ejection amount is 90 ng (30×3). When the image is formed with such an ejection amount, the reflection density is as shown in FIG. 11. Since the density is proportional to the ink ejection amount, three levels of the densities can be provided. In other words, 4 tone levels are provided by two heaters which are large and small.

EMBODIMENT 3

Figure 12:
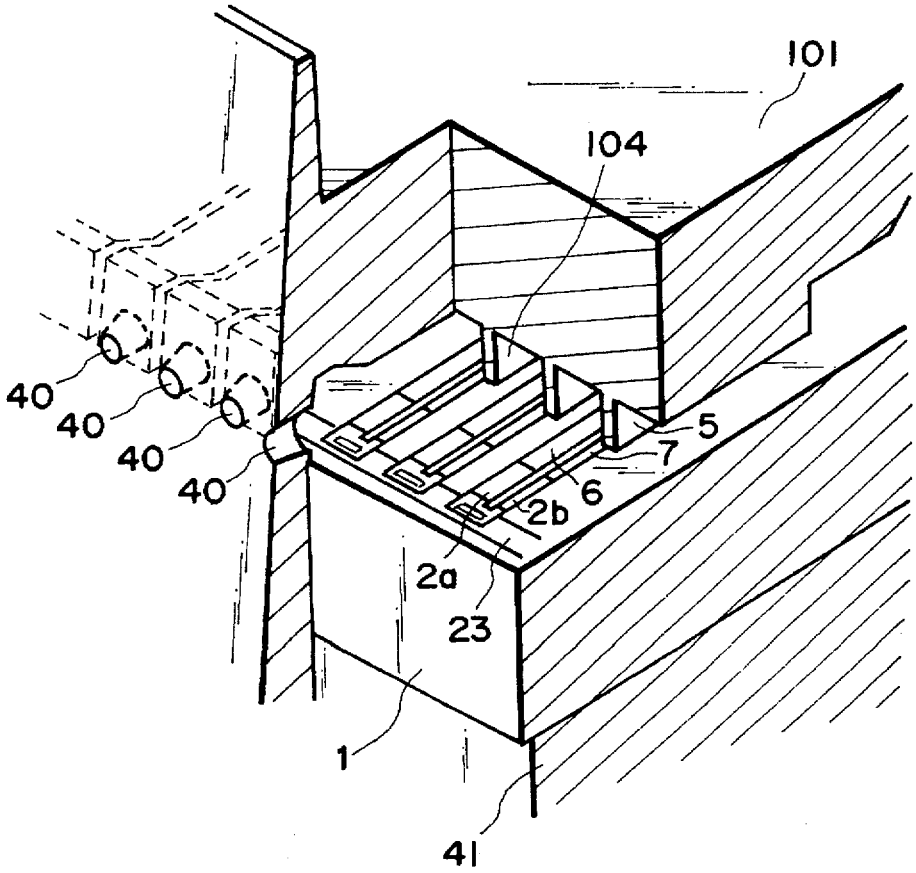
FIG. 12 shows an example of a construction of an ink jet recording head according to an embodiment of the present invention.
Figure 13:
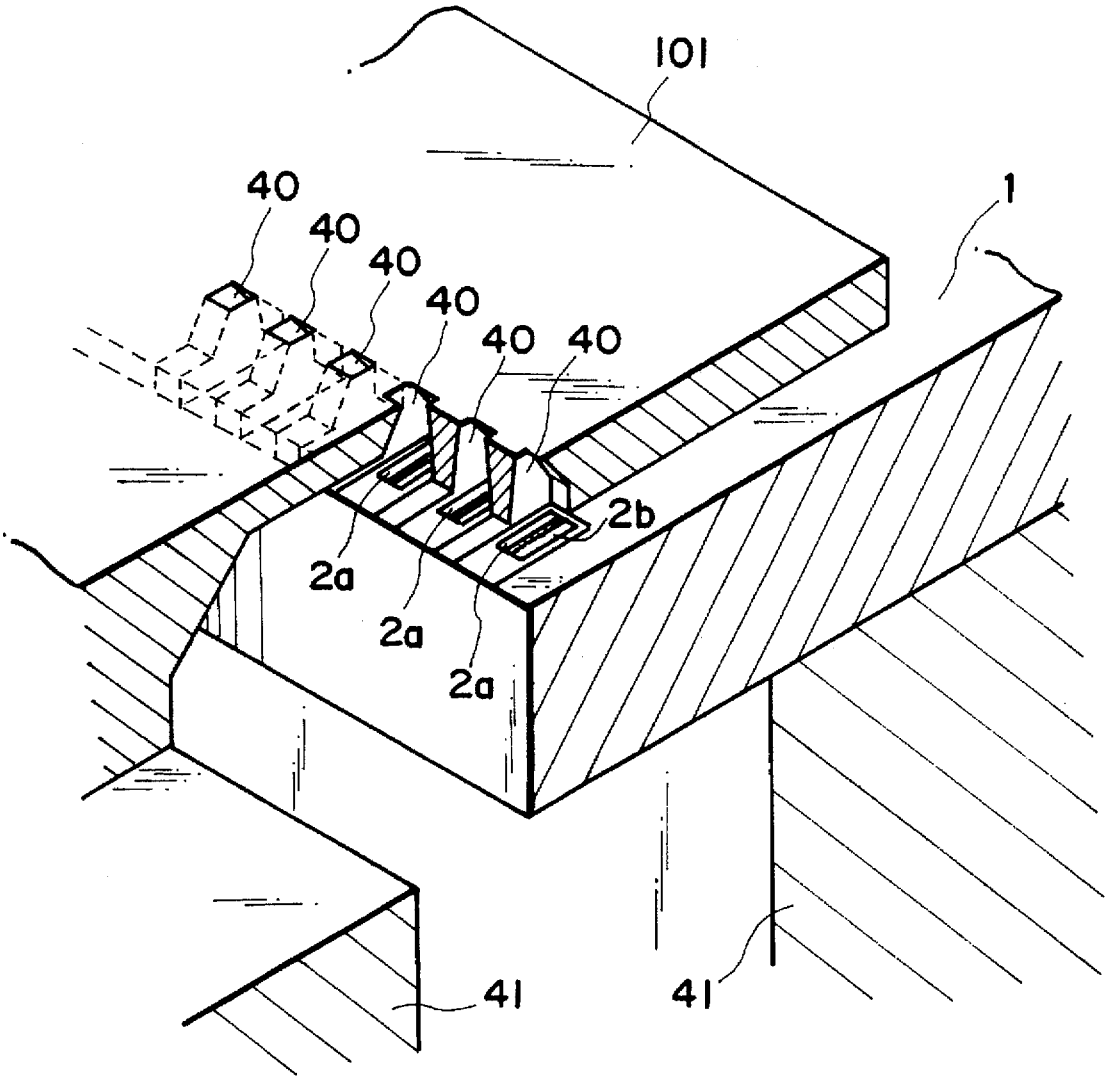
FIG. 13 shows example of a construction of ink jet recording head according to an embodiment of the present invention.

The structure of the head described above will be more specifically described. FIG. 12 and 13 show the construction around the nozzle. They are called edge shooter type and side shooter type, respectively. The ink in the liquid flow path 104 is heated and a bubble is generated by the ejection heaters 3 and 4 to eject the ink through the ejection outlet 40 which is open in the horizontal direction in the drawing (along the surface having the heater, in the edge shooter type, or upwardly (in the direction normal to the surface having the heater) in the side shooter type. The element substrate 1 is bonded to the base plate 41, and the nozzle wall 5 is formed in the top plate 101.

Figure 14:
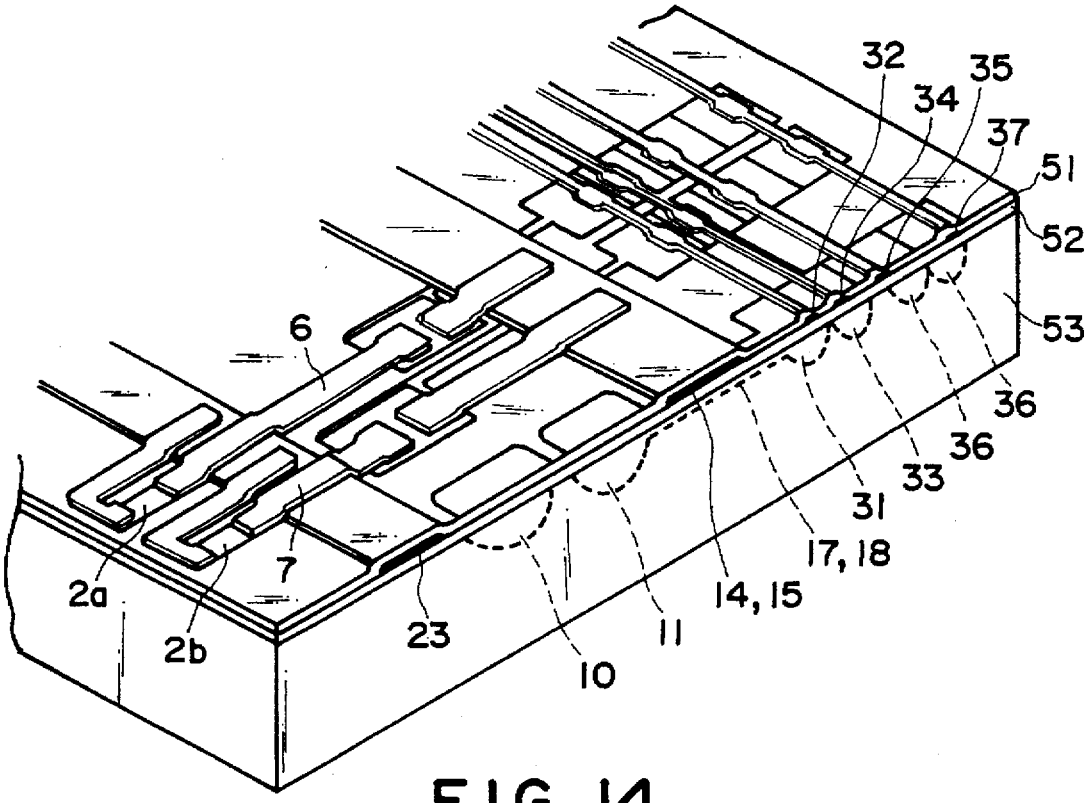
FIG. 14 shows a modified example of FIG. 5.
Figure 15:
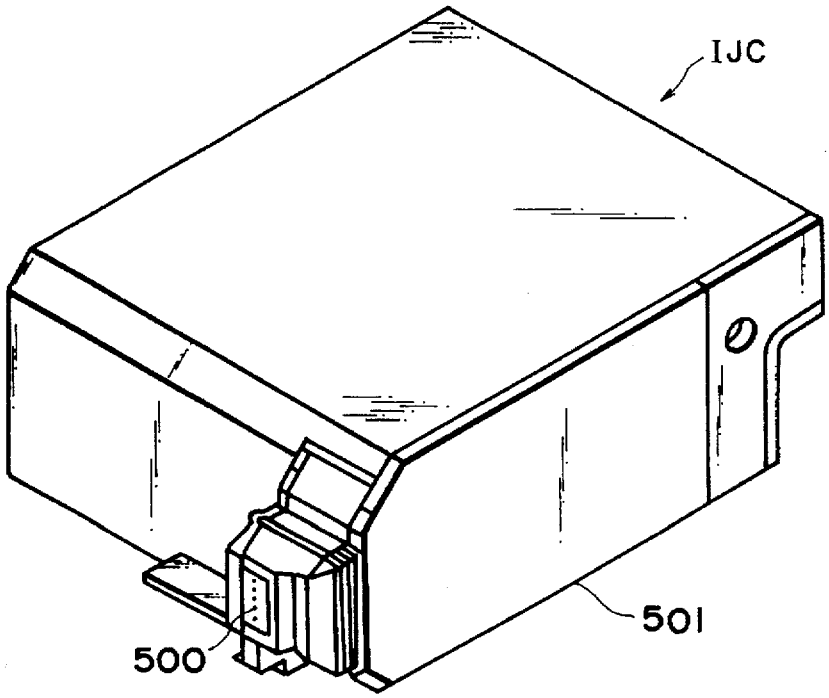
FIG. 15 illustrates an ink jet head cartridge using the head according to an embodiment of the present invention.

FIG. 14 shows a fundamental construction although the substrate is slightly different for the structure shown in FIG. 15. Below the ejection heaters 2a and 2b, an insulation film 51 is provided to provide electric insulation between the aluminum wiring B (wiring 6 and 7) at the heater side and aluminum wiring A (common wiring 1, ground wirings 14 and 15). The transistors 10 11 are connected with a silicon layer 53 through latch 33 and AND gate 31. The transistor 10, 11, AND gate 31, latch 33 and shift register 36 are formed in the silicon layer 53.

EMBODIMENT 4

FIG. 15 shows an ink jet head cartridge having an ink jet head and a separable ink container containing the ink to be supplied to the ink jet head.

The injection of the ink into the ink container of the ink jet head cartridge is carried out as follows.

By connection an ink supply pipe or the like to the ink container, an ink introduction path for the ink filling is constituted, and the ink supplied into the ink container through the ink introduction path. As for ink supply openings, the supply opening or the air vent of the ink jet head side and a hole in the wall of the ink container, are usable.

EMBODIMENT 5

Figure 16:
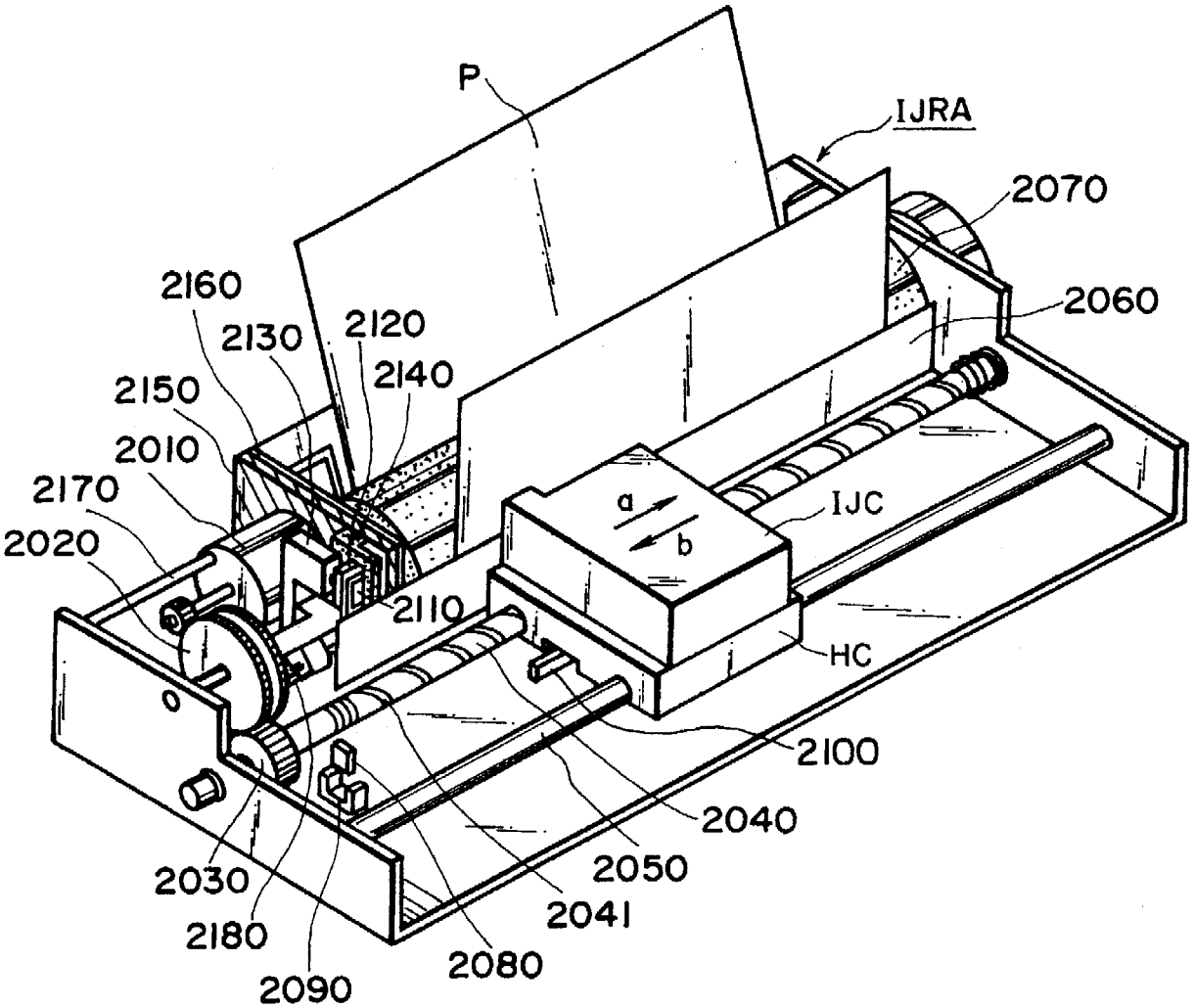
FIG. 16 shows an example of a construction of ink jet recording head mounted on an ink jet recording head according to an embodiment of the present invention.

FIG. 16 is a schematic view of an example of the ink jet recording device having the ink jet recording head described above. The ink jet recording device IJRA has a lead screw 2040 rotatable through driving force transmission gears 2020 and 2030 in interrelation with the reversible rotation of a driving motor 2010. The carriage HC carrying the the ink jet cartridge IJC having integral ink jet wiring head and ink container is supported on the carriage shaft 2050 and the lead screw 2040, and has a pin (unshown) for engagement with a spiral groove 2041 of the lead screw 2040, and is reciprocation moved in the b direction indicated by an arrow a in accordance with the rotation of the lead screw 2040. Designated by 2060 is a sheet confining plate, and urges the paper P to the platen roller 2070 along the carriage movement direction. A photo-coupler is constituted by elements 2080 and 2090, it confirms existence of a lever 2100 of the carriage HC in this area to effect rotational direction switching of the motor 2010, that is, the photo-coupler functions as a home position detecting means. Designated by 2110 is a cap member for caping the before surface of the recording head, and is supported by supporting member 2120. Designated by 2130 is a sucking means for sucking the inside of the cap to effect the sucking recovery of the recording head through the opening of the cap. A cleaning blade 2140 for cleaning the end surface of the recording head is mounted on a member 2150 for movement in the to and fro direction, and they are supported on a supporting plate 2160 of the main assembly. The blade 2140 is not limited to the structure, but known cleaning blade is usable in this example. A lever 2170 is operable to start the sucking of the sucking recovery operation and is movable with the movement of a cam 2180 engaged with the carriage HC, so that the driving force from the driving motor 2010 is selectively transmitted by known transmitting means such as clutch switching means.

The capping, cleaning and sucking recovery operations are carried out when the carriage HC reaches the home position side region, by the operation of the lead screw 2040 at the respective positions. But, another known timing and operation are usable. The above-described constructions are preferable individually or in combination in practicing the present invention.

Figure 17A:
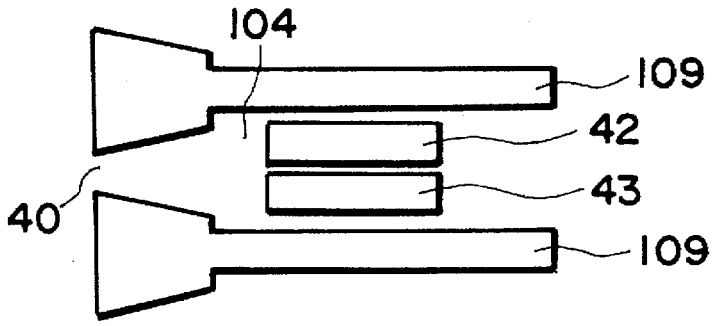
FIGS. 17(*a*)–17(*c*) show an example of a construction of an ink jet recording head according to another embodiment of the present invention.
Figure 17B:
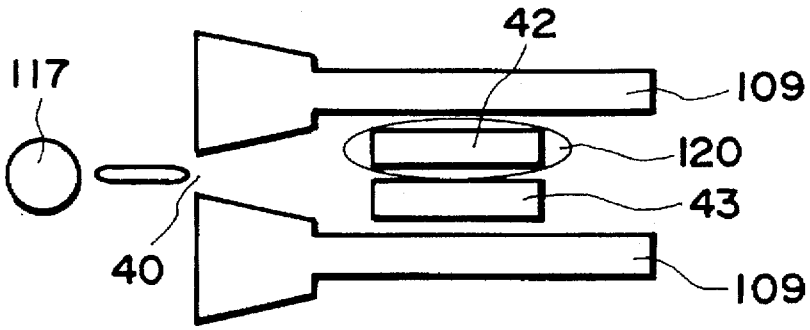
Figure 17C:
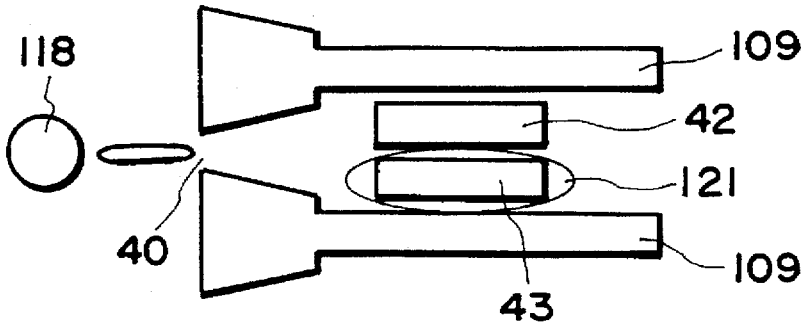

FIG. 17 shows a fundamental structure of a long lifetime heater usable with the present invention. As shown in FIG. 17, (a), a first heater 42 and a second heater 43 juxtaposed along the length has the same heater size. Therefore, the ejection amounts of the droplets 117 and 118 ejected by energizing the first heater 42 and by energizing the second heater 43, are the same. With this structure, the ejection data are alternately assigned to the two heaters to double the heater lifetime. Instead of alternate use of the heaters, it is a possible alternative that the first heater 42 is first used, and the second heater 43 is after the first heater 45 is actuated for a predetermined number of times or the first heater 42 is broken by electric disconnection or the like.

EMBODIMENT 6

Figures 18A, 18B:
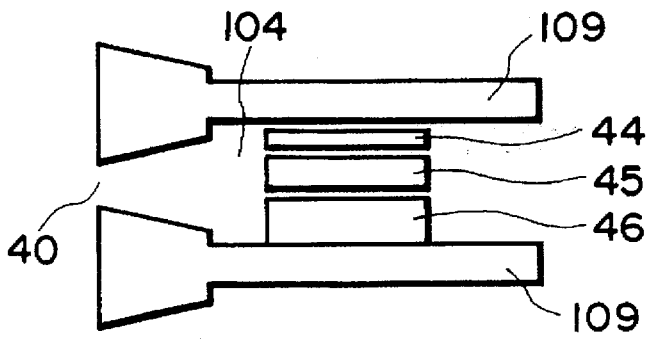
FIGS. 18(*a*) and 18(*b*) show an example of a control for a 8 tone gradient in an ink jet recording head according to an embodiment of the present invention.

FIG. 18 shows an example of 8 level tone gradient control. As shown in FIG. 18, (a), in this case, the heater sizes of the small ejection heater 2c, intermediate election heater 2b and the large ejection heater 2a juxtaposed, satisfy 1:2:4. By the combination of the three heaters, the ejection amount can be controlled with increment of 10 ng step from 0–70 ng, so that the image quality can be improved. The manner of the control is shown in (b).

Similarly, by using 4 heaters, 16 tone gradient levels can be used, and in more generic way, by using x heaters, 2x tone levels become available. The ejection heater of this embodiment also uses the positional features of embodiment 1.

EMBODIMENT 7

Figure 19:
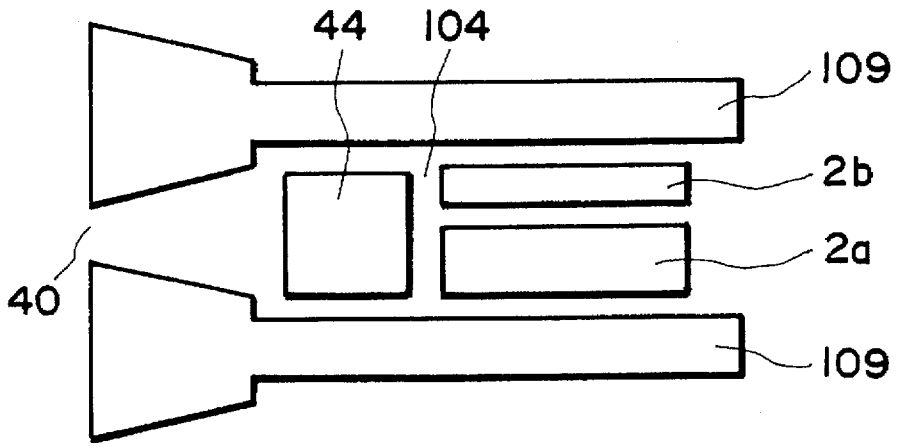
FIG. 19 shows example of a construction for analog tone gradient in an ink jet recording head according to an embodiment of the present invention.

FIG. 19 shows a construction for analog tone gradient. This embodiment uses the fact that the temperature of the ink in the ink jet recording head is influential to the ejection amount, and the ink temperature is controlled to provide a predetermined ejection amount.

Figure 20:
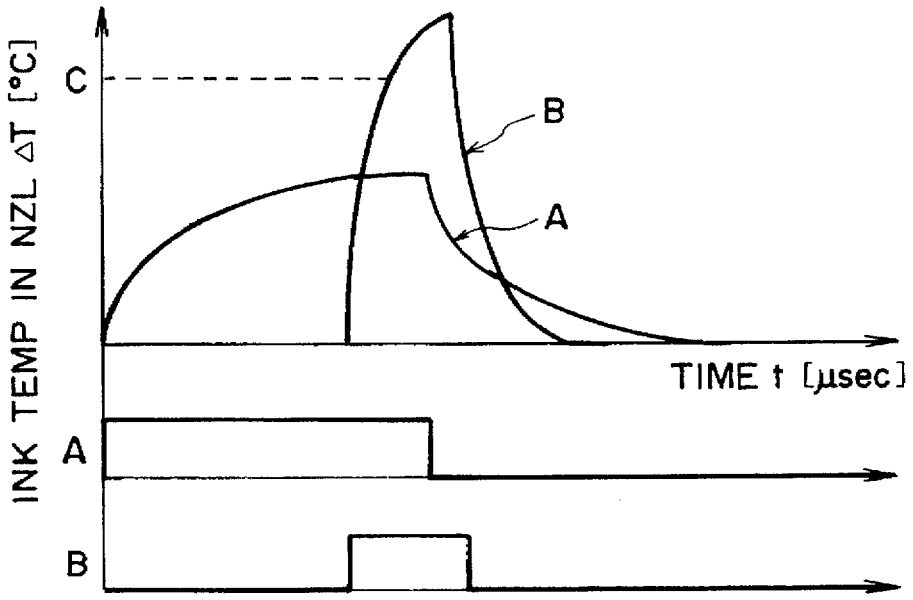
FIG. 20 shows example of control for construction of FIG. 19.
Figure 21:
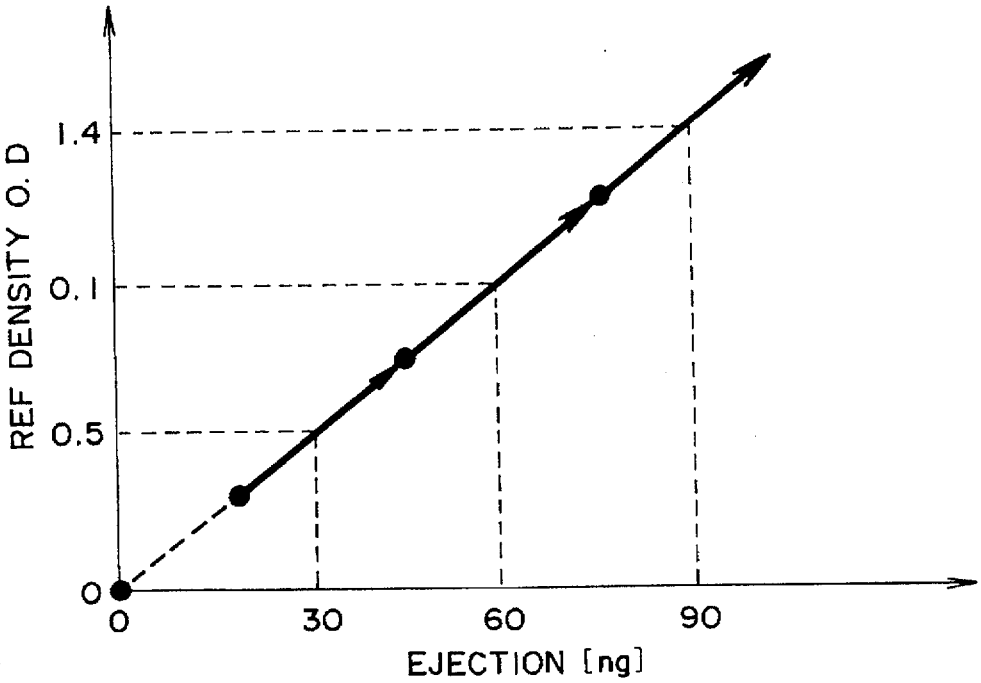
FIG. 21 shows example of reflection temperature in the construction of FIG. 19.
Figure 22:
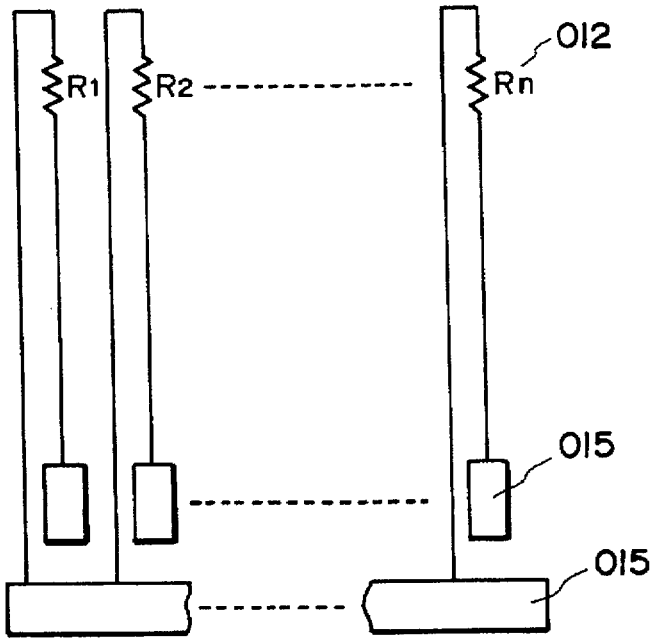
FIG. 22 PRIOR ART
FIG. 22 shows an equivalent circuit for a construction of a substrate of a conventional ink jet head.
Figure 23:
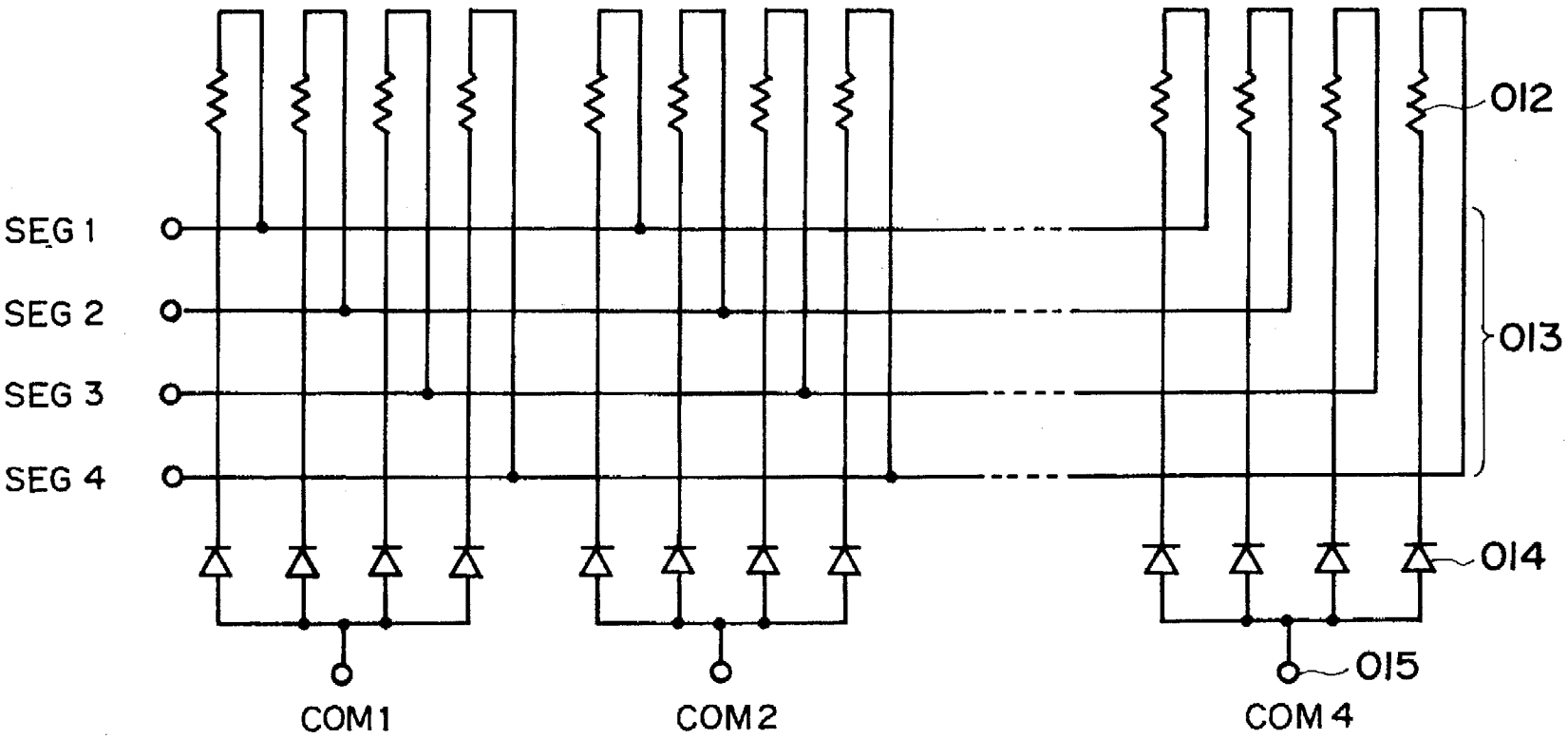
FIG. 23 shows an equivalent circuit of a substrate construction of an ink jet head.

As Shown in FIG. 19, in this embodiment, there are provided large and small ejection heaters 2*a* and 2*b* juxtaposed and an ink pre-heating heater 44 in front thereof in the ink ejecting direction. This embodiment utilizes the fact that an amount of larger with the same bubble generation power amount of the ink can be ejected if the temperature is higher, since then the ink viscosity is lower, the ink pre-heating heater 44 is effective for pre-heating of the ink to provide fine change of the ejection amount. For example, as shown in FIG. 20, the ink temperature is raided by the signal A applied to the ink pre-heating heater 44, and then the signal B is applied to the ejection heater 2*a* or 2*b* to eject the ink. At this time, point C designates the temperature at which the bubble generation of the ink occurs, and the temperature of the ink provided by the ink pre-heating heater 44 does not exceed this temperature. With this system, the digital tone gradient of embodiment 1 can be operated as analog-like tone gradient in effect, as shown in FIG. 21.

The change of the ejection amount due to the change of the head temperature can be suppressed by controlling the ink temperature in the ejection nozzle 104 by the ink pre-heating heater 44 to provide a predetermined ejection amount. In a conventionally method of ejection amount control for a single heater, a pre-pulse is applied prior to the main pulse to effect the pre-heating. If the pre-pulse is large, the bubble generation may occur, and therefore, the ink heating is limited to a degree lower than predetermined. However, according to this this embodiment, the ink pre-heating heater 44 is independent from the ejection heater, and therefore, a large heater having low power per unit area of the heater for heating up to a degree of not producing bubble generation, is usable for pre-heating so that the ejection amount control can be enhanced.

As described above, a plurality of heaters are provided in a single nozzle, and the function element is provided in the substrate, by which the following advantageous effects can be provided.

1. the heater size for providing a predetermined ejection amount can be reduced, and therefore, the energy saving can be accomplished correspondingly, so that the voltage source cost and the driver cost can be reduced.
2. since the heat generation in the non-bubble-generation region results in the wasteful energy and in addition functions to rise the temperature of the head, the viscosity of the ink having the temperature dependence property decreases with the result of variation of the ejection amount and therefore deterioration of the printing quality. However, the above-described reduction of the non-bubble-generation region can suppress the reduction of the viscosity and the deterioration of the printing quality.
3. the tone gradient control is possible with downsized head and device without cost increase.
4. the tone gradient control is possible without shortening the lifetime of the electrothermal transducer element.
5. the tone gradient control is possible with a smaller number of data (2x tone gradient levels with x bit) so that the data transfer time can be reduced, and the memory cost reduction is accomplished,
6. the tone gradient controllable is possible without increasing the driving oscillation of the nozzle.
7. since the position of the pixel is not deviated, the image quality is not deteriorated.
8. by sharing the ejection jobs by same size heaters, the lifetime expansion is accomplished.
9. by using a heater not producing a bubble, the effect of ejection amount control can be enhanced.

Particularly, it should be noted that the coat increase is hardly required despite the foregoing advantages, and the downsizing is accomplished, in the embodiment wherein the function element is provided in the substrate.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head comprising:

a plurality of liquid flow paths for ejecting the ink; and a plurality of heat generating resistors for said respective liquid flow paths, said heat generating resistor being independently drivable;

wherein adjacent ones of said heat generating resistors are spaced by not more than 8 microns.

2. An ink jet head according to claim 1, wherein the space is not more than 6 microns.

3. An ink jet head according to claim 1, wherein said heat generating resistor has a rectangular configuration having a long side along said liquid flow path.

4. An ink jet head according to claim 1, wherein two of such heat generating resistors are provided in one said liquid flow path.

5. An ink jet head according to claim 1, wherein the plurality of heat generating resistors are substantially parallel along the length.

6. An ink jet head according to claim 1, wherein the plurality of heat generating resistor are disposed on an element substrate, and said element substrate has a shift register and a latching circuit for driving the plurality of heat generating resistor.

7. An ink jet head according to claim 4, wherein said two heat generating resistors have different areas.

8. An ink jet head according to claim 4, the two heat generating resistors have substantially the same configuration.

9. An ink jet head according to claim 4, a distance from said ejection outlet to said two heat generating resistors are substantially the same.

10. An ink jet head according to claim 1, wherein an ejection direction of the ink is codirectional with said heat generating resistor.

11. An ink jet head according to claim 1, wherein an ejection direction of the ink is substantially perpendicular to a surface of said heat generating resistor.

12. An ink jet head cartridge for effecting recording by ejection ink, comprising: An ink jet head as defined in claim 1; and an ink container for containing ink to the ink jet head.

13. An ink jet head cartridge according to claim 12, wherein said ink container is detachably mountable relative to said ink jet head.

14. An ink jet recording device for effecting recording by ejecting ink, comprising:

an ink jet head as defined in claim 1; and transporting means for transporting a recording material on which the recording is effected.

15. An ink jet recording device for effecting recording by ejecting ink, comprising:

an ink jet head as defined in claim 1; and driving signal supply means for driving said head.

16. An ink container for constituting an ink jet head cartridge as defined in claim 12, wherein ink has been refilled into said ink container.

* * * * *

UNITED STATES PATENT AND TRADEMARK OFFICE

CERTIFICATE OF CORRECTION

PATENT NO. : 5,731,828

DATED : March 24, 1998

INVENTOR(S) : HIROYUKI ISHINAGA ET AL.

It is certified that error appears in the above-identified patent and that said Letters Patent is hereby corrected as shown below:

COLUMN 1

Line 12, "applicatin" should read --application--;
Line 17, "device" should read --devices--;
Line 22, "may" should read --many--;
Line 38, "an" should read --the--;
Line 41, "be" should read --by--;
Line 43, "Since the" should read --The--;
Line 54, "of of" should read --of--;
Line 55, "of of" should read --of--;
Line 56, "n+ one" should read --n + one--;
Line 59, "a" should be deleted; and
Line 66, "When electric" should read --Electric--.

COLUMN 2

Line 2, "of of" should read --of--;
Line 3, "of of" should read --of--;
Line 6, "of of" should read --of--;
Line 8, "of of" should read --of--;
Line 21, "of of" should read --of--;
Line 30, "are optimization" should read --is optimized--;
Line 35, "of" should be deleted;
Line 42, "An" should read --an--;
Line 43, "ink;" should read --ink--; and
Line 45, "drivable;" should read --drivable,--.

UNITED STATES PATENT AND TRADEMARK OFFICE

CERTIFICATE OF CORRECTION

PATENT NO. : 5,731,828

DATED : March 24, 1998

INVENTOR(S) : HIROYUKI ISHINAGA ET AL.

It is certified that error appears in the above-identified patent and that said Letters Patent is hereby corrected as shown below:

COLUMN 3

Line 6, "of of" should read --of--;
Line 7, "transducer" should read --transducers-- and "1" should read --one--;
Line 18, "is" should read --is a-- and "set" should read --jet--;
Line 19, "and" should read --an--;
Line 29, "shows" should read --shows an--;
Line 42, "a 8" should read --an 8--;
Line 45, "shows" should read --shows an--;
Line 48, "shows" should read --shows an--; and
Line 50, "shows" should read --shows an--.

COLUMN 4

Line 2, "and a" should read --and an--;
Line 19, "of of" should read --of--;
Line 25, "the of" should read --the temperature of--;
Line 29, "exhibit" should read --exhibits--;
Line 35, "nor" should read --not--;
Line 60, "exhibit" should read --exhibits--; and
Line 67, "rise" should read --raise--.

UNITED STATES PATENT AND TRADEMARK OFFICE

CERTIFICATE OF CORRECTION

PATENT NO. : 5,731,828

DATED : March 24, 1998

INVENTOR(S) : HIROYUKI ISHINAGA ET AL.

It is certified that error appears in the above-identified patent and that said Letters Patent is hereby corrected as shown below:

COLUMN 5

Line 8, "of of" should read --of--; and
Line 58, "(2 $W_A$," should read --(2 $W_A$),--.

COLUMN 6

Line 3, "corresponding" should read --Corresponding--;
Line 6, "since" should read --Since-- and
"In" should read --in--;
Line 8, "rise" should read --raise--; and
Line 64, "The the" should read --The--.

COLUMN 7

Line 1, "line Then," should read --line 34. Then,--.
Line 2, "to a" should read --to an--;
Line 56, "transistors 1011" should read
--transistors 10, 11--;
Line 57, "transistor" should read --transistors--; and
Line 66, "connection" should read --connection of--.

UNITED STATES PATENT AND TRADEMARK OFFICE

CERTIFICATE OF CORRECTION

PATENT NO. : 5,731,828

DATED : March 24, 1998

INVENTOR(S) : HIROYUKI ISHINAGA ET AL.

It is certified that error appears in the above-identified patent and that said Letters Patent is hereby corrected as shown below:

COLUMN 8

Line 1, "ink supplied" should read --ink is supplied--;
Line 17, "reciprocation" should read --reciprocatingly--; and
Line 19, "plate, and" should read --plate which--.

COLUMN 9

Line 12, "Shown" should read --shown--;
Line 16, "an amount of larger" should read --a larger amount--;
Line 33, "conventionally" should read --conventional--;
Line 38, "this this" should read --this--;
Line 48, "the" should read --The--;
Line 53, "since" should read --Since--;
Line 55, "rise" should read --raise--;
Line 63, "the" should read --The--; and
Line 65, "the" should read --The--.

UNITED STATES PATENT AND TRADEMARK OFFICE

CERTIFICATE OF CORRECTION

PATENT NO. : 5,731,828

DATED : March 24, 1998

INVENTOR(S) : HIROYUKI ISHINAGA ET AL.

It is certified that error appears in the above-identified patent and that said Letters Patent is hereby corrected as shown below:

COLUMN 10

Line 1, "the" should read --The--;
Line 5, "the" should read --The--; and
"controllable" should read --control--;
Line 7, "since" should read --Since--;
Line 9, "by" should read --By--;
Line 11, "by" should read --By--;
Line 43, "resistor" should read --resistors--;
Line 49, "the" should read --wherein the--;
Line 52, "a" should read --wherein a--;
Line 53, "are" should read --is--; and
Line 62, "ejection" should read --ejecting--; and
"An" should read --an--.

Signed and Sealed this

Fifteenth Day of December, 1998

Bruce Lehman

*Attest:*

BRUCE LEHMAN

*Attesting Officer*

*Commissioner of Patents and Trademarks*